US005322983A

United States Patent [19]

Tseng

[11] Patent Number: 5,322,983

[45] Date of Patent: Jun. 21, 1994

[54] STRUCTURE OF SLIDING BLOCK ELECTRICAL SWITCH

[76] Inventor: Tien-Fu Tseng, 9F-3, No. 218, Kuo Kuang Rd., Taichung, Taiwan

[21] Appl. No.: 56,843

[22] Filed: May 4, 1993

[51] Int. Cl.[5] ..... H01H 15/06

[52] U.S. Cl. ..... 200/549; 200/548; 200/547; 200/550

[58] Field of Search ..... 200/547, 548, 549, 550, 200/241, 252, 257

[56] References Cited

U.S. PATENT DOCUMENTS 3,502,825 3/1970 Bailey et al. ..... 200/547
4,886,946 12/1989 Franks, Jr. ..... 200/547
5,153,401 10/1992 Tseng ..... 200/550

*Primary Examiner*—Henry J. Recla
*Assistant Examiner*—David J. Walczak
*Attorney, Agent, or Firm*—Morton J. Rosenberg; David I. Klein

[57] ABSTRACT

An electrical switch includes a base, a sliding block, two short circuit metal pieces, contact metal pieces, and a cover. The base has a rectangular top slot, which receives the sliding block, and an elongate guide groove in the middle of the rectangular top slot along the length, which guides a bottom rail on the sliding block. Each short circuit metal piece has a protruded portion on a contact surface thereof engaged into a locating groove on a stop wall at either long side of the base for positioning.

1 Claim, 4 Drawing Sheets

STRUCTURE OF SLIDING BLOCK ELECTRICAL SWITCH

BACKGROUND OF THE INVENTION

The present invention relates to switching devices, and more particularly to an improved structure of sliding block electrical switch which eliminates the drawbacks of the sliding block electrical switch of U.S. Pat. No. 5,153,401, which is also an invention of the present inventor.

The sliding block electrical switch according to U.S. Pat. No. 5,153,401, as shown in FIG. 1, which comprises a base 1, which has a rectangular slot 12, depressions 13 located by each of two long sides of the rectangular slot 12 and respectively separated by walls 131, and holes 16, contact metal pieces 15 respectively lodged in the depressions 13, a sliding block 2, which has a protruded portion 21 and a clamping block 22, two short circuit metal pieces 23 received in the rectangular slot 12 and respectively retained between the protruded portion 21 and the clamping block 22 of the sliding block 2 and moved by the sliding block 2 to make contact with the contact metal pieces 15 adjacent to each other, and a cover 3, which has hooks 31;32 respectively hooked in holes 16 on the base 1. This structure of sliding block electrical switch is easy to assemble and disassemble manually without the use of any tools or fastening elements. As shown in FIG. 2, the sliding block 2 is capable of moving in the rectangular slot 12 so as to trigger the short circuit metal pieces 23 to make contact with the contact metal pieces 15 located at different positions in order to carry out the function of circuit switching. In order to let the sliding block 2 be moved in the rectangular slot 12, the width of the sliding block 2 must be narrower than the width of the rectangular slot 12. This limitation affects the stability of the sliding of the sliding block 2 in the rectangular slot 12. Because there is no positioning means to hold the sliding block 2 in the rectangular slot 12 and the contact between the short circuit metal pieces 23 and the contact metal pieces 15 is a contact between plains and circular surfaces, a contact error may occur easily.

SUMMARY OF THE INVENTION

The present invention eliminates the drawbacks of the sliding block electrical switch of U.S. Pat. No. 5,153,401. It is therefore the principal object of the present invention to provide an improved structure of sliding block electrical switch which allows the switching control sliding block thereof to be stably moved in the rectangular slot of the base thereof without deviating from the course. According to the preferred embodiment of the present invention, the sliding block electrical switch comprises a base having at the central portion of a top surface thereof a rectangular slot, an elongate guide groove disposed in the middle of the rectangular slot along the length, three depressions located by each of two long sides of the rectangular slot, each two adjacent depressions being separated by a respective partition wall, each partition wall having one shorter side perpendicularly connected to a respective stop wall in the middle and an opposite shorter side connected to an outer wall at right angles, each stop wall being located by one long side of the rectangular slot and having a locating groove vertically disposed on one side thereof adjacent to the rectangular slot; a sliding block in a rectangular shape disposed in the rectangular slot, the length of the sliding block being approximately equal to the combined length of two depressions, the sliding block comprising a bottom rail slidably fitted into the guide groove in the rectangular slot, two recesses bilaterally disposed at a bottom surface thereof, two clamping blocks bilaterally disposed at two long sides thereof and respectively spaced from either recess by a gap; two short circuit metal pieces respectively fastened to the sliding block at two opposite sides, each short circuit comprising a straight contact surface having two opposite ends bent inwards and inserted into the respective recess on the sliding block and hooked on the respective clamping block, the straight contact surface of each short circuit metal piece having a protruded portion engaged into the locating groove on either stop wall; contact metal pieces lodged in the depressions and equal in number and substantially in height to the depressions, the contact metal pieces each being of triangular construction, said contact metal pieces each comprising a support portion stopped between two adjacent stop walls, a contact surface projected from the support portion toward the rectangular slot for the contact of either short circuit metal piece, and a clamping portion for fastening a respective electrical wire; and a cover covered on said base at the top to hold the sliding block in the rectangular slot, the cover having a rectangular opening disposed in the middle corresponding to the rectangular slot.

DETAILED DESCRIPTION OF THE PREFERRED EMBODIMENT

Figure 1:
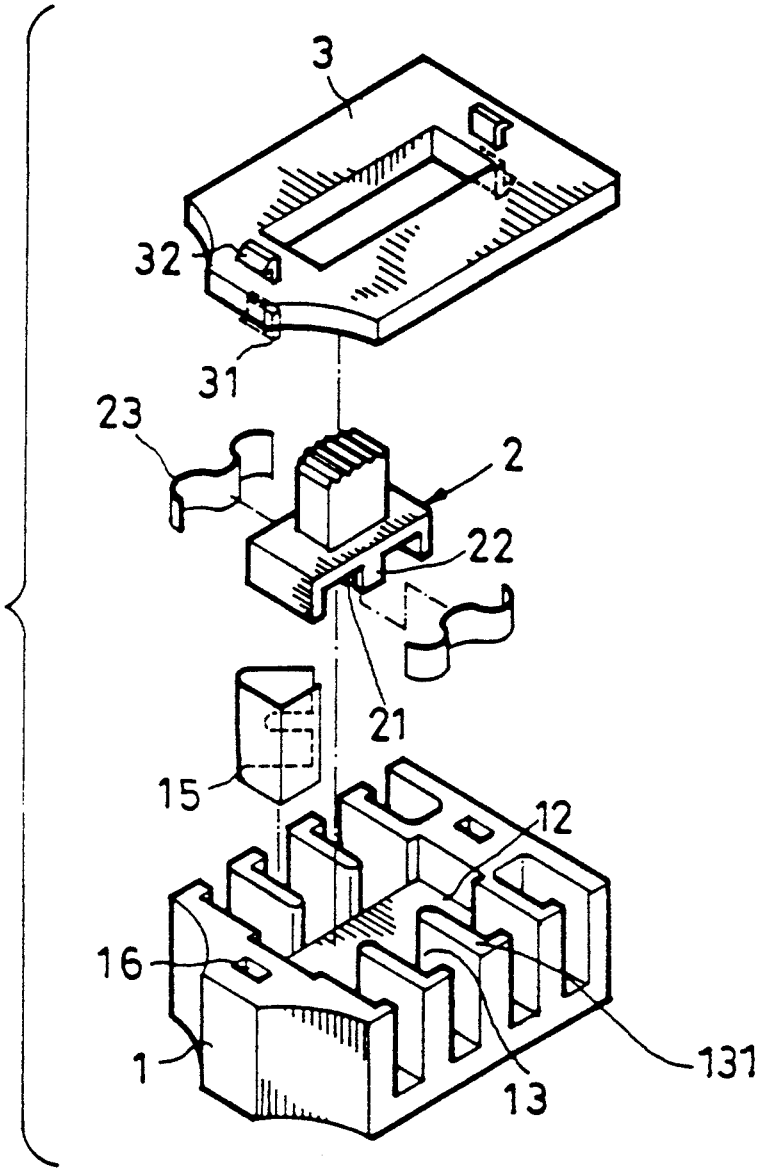
PRIOR ART FIG. 1
FIG. 1 is an exploded view of an electrical switch according to U.S. Pat. No. 5,153,401.
Figure 2:
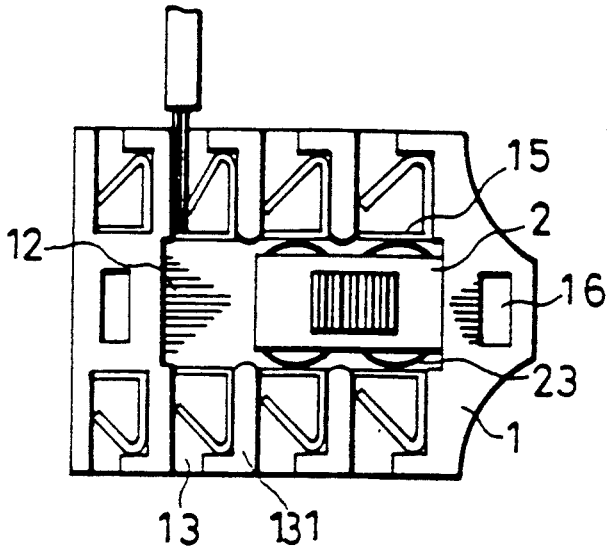
PRIOR ART FIG. 2
FIG. 2 is a top assembly view of the electrical switch shown in FIG. 1 (excluding the cover)
Figure 3:
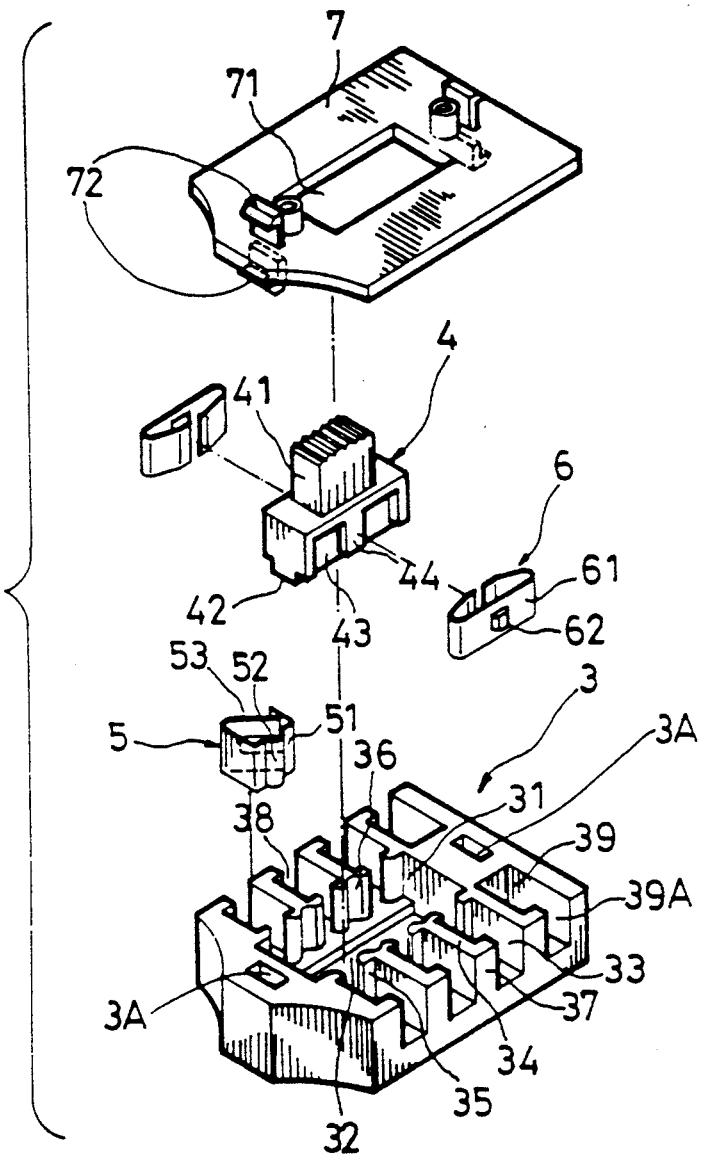
FIG. 3 is an exploded view of an electrical switch according to the preferred embodiment of the present invention.
Figure 4:
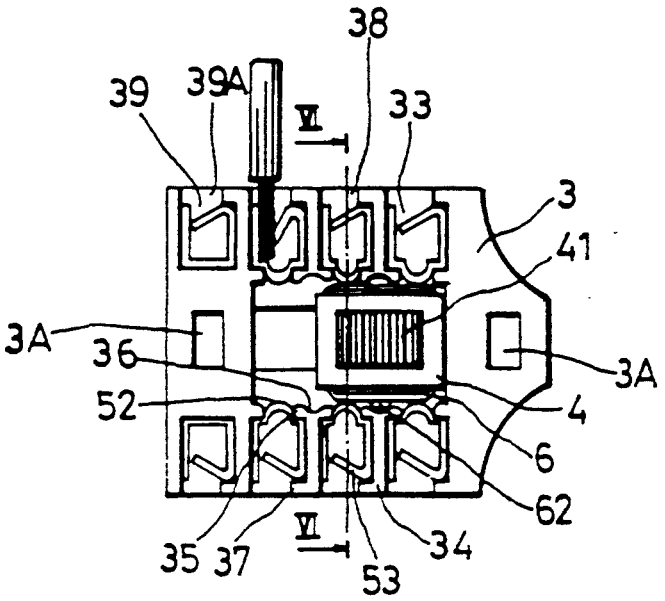
FIG. 4 is a bottom view of the electrical switch shown in FIG. 3.

Referring to FIGS. 3 and 4, the sliding block electrical switch in accordance with the preferred embodiment of the present invention is generally comprised of a base 3, a sliding block 4, and a cover 7. The base 3 comprises at the central portion of a top surface thereof a rectangular slot 31. An elongate guide groove 32 is disposed in the middle of the rectangular slot 31 along the length. Located by each of two long sides of the rectangular slot 31 are three depressions 33. Two adjacent depressions 33 are partitioned by means of a wall 34. The wall 34 has one shorter side perpendicularly connected to a stop wall 35 in the middle and an opposite shorter side connected to an outer wall 37 at right angles. The stop wall 35 is located by one long side of the rectangular slot 31. A locating groove 36 is made on one side of the stop wall 35 adjacent to the rectangular slot 31. The depression 33 communicates with the rectangular slot 31. An insertion slot 38 is disposed at an outer side of the depression 33. Further, the base 3 comprises at both sides thereof a slot 39, which is similar to the depression 33 and is not connected with the rectangular slot 31. An insertion slot 39A is disposed at an outer side of the slot 39. Lodged in the depression 33 is a contact metal piece 5, which is equal in height to the depression 33 and is of a triangular construction arranged in such a manner that it obstructs the common passage shared by both rectangular slot 31 and depression 33. The contact metal piece 5 comprises a support portion 51 stopped between two adjacent stop walls 35, a contact surface 52 projected from the support portion 51 toward the rectangular slot 31 for the contact of the short circuit metal pieces 6 moved by the sliding block 4, and a clamping portion 53.

The sliding block 4 is made to slide in the rectangular slot 31. The length of the sliding block 4 is approximately equal to the combined length of two depressions 33. The sliding block 4 comprises a protruded block 41 disposed at the upper edge of the top surface thereof, and made for use in moving the sliding block 4 by the user, an elongate bottom rail 42 disposed at the bottom in a longitudinal direction and made to slide in the guide groove 32 on the base 3 for guiding the sliding of the sliding block 4 in the rectangular slot 31. A recess 43 is made on both long sides of the sliding block 4. A clamping block 44 is disposed by the outer side of the long side of the sliding block 4 and spaced from the recess 43 by a clearance.

Two short circuit metal pieces 6 are fastened to the sliding block 4 and moved by it to make contact with the contact metal pieces 5 adjacent to each other. The short circuit metal piece 6 comprises a straight contact surface 61 having two opposite ends bent inwards and inserted into the recess 43 and hooked on the clamping block 44. A protruded portion 62 is made on the straight contact surface 61 in the center and fitted into the locating groove 36.

The cover 7 covers on the base 3 to hold the sliding block 4 to the base 3. Hooks 72 are made respectively at the bottom and the top surfaces of the cover 7 and inserted into holes 3A on the base 3, and therefore the cover 7 is fastened to the base 3. A rectangular opening 71 is disposed in the middle of the cover 7 corresponding to the rectangular slot 31 on the base 3 through which the protruded block 41 projects over the cover 7 for moving by the user.

Figure 5:
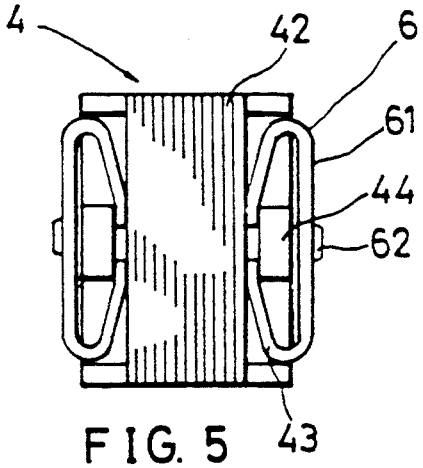
FIG. 5 is a top assembly view of the electrical switch shown in FIG. 3 (excluding the cover)
Figure 6:
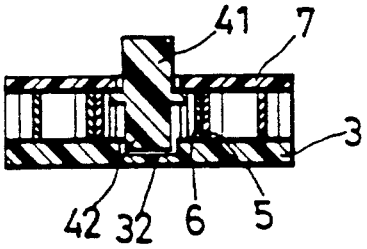
FIG. 6 is a cross sectional view taken along line VI—VI of FIG. 4 (including the cover).

Referring to FIGS. 5 and 6, when assembled, the sliding block 4 is received in the rectangular slot 31 with the bottom rail 42 slidably fitted into the elongate guide groove 32. When moved, the bottom rail 42 is guided by the elongate guide 32, and therefore, the sliding block 4 does not deviate from the course. As the sliding block 4 is moved from one contact point to another in the rectangular slot 31, the protruded portion 62 on the straight contact surface 61 of either short circuit metal piece 6 respectively engages into the locating groove 36 on the respective stop wall 35 adjacent to each other, and therefore the contact surface 61 of either short circuit metal piece 6 is firmly maintained in contact with the contact surface 52 of the respective contact metal piece 5 adjacent to each other.

Further, an electrical cable can be conveniently fastened to either contact metal piece 5 by by inserting the conductor of the electrical cable in between the clamping portion and the support portion 51.

While only one embodiment of the present invention has been shown and described, it will be understood that various modifications and changes could be made without departing from the spirit and scope of the invention.

What is claimed is:

1. An electrical switch comprising:

a base having a rectangular slot in a top surface of a central portion thereof, an elongate guide groove disposed in a middle portion of said rectangular slot and extending lengthwise thereof, three depressions located in each of two long sides of said rectangular slot, a plurality of partition walls, each two adjacent depressions being separated by a respective partition wall, each partition wall having one side perpendicularly connected to a respective stop wall and an opposite side connected to an outer wall at a right angle thereto, each stop wall being located adjacent one of said long sides of said rectangular slot and having a locating groove vertically disposed on one side thereof adjacent to said rectangular slot;

a rectangularly shaped sliding block disposed in said rectangular slot, a length of said sliding block being approximately equal to the combined length of two adjacent depressions, said sliding block comprising, (1) a protruding block, (2) two long sides, (3) two short sides, (4) a bottom rail slidably inserted into said guide groove in said rectangular slot, (5) a pair of recesses, each of said pair of recesses being disposed on each long side thereof, and a (6) clamping block disposed at each long side thereof and respectively spaced from a respective one of said recesses by a clearance;

two short circuit metal pieces respectively fastened to said sliding block at said two long sides, each short circuit piece comprising a straight contact surface having two opposite ends bent inwardly and inserted into the respective clearance on said sliding block and hooked on the respective clamping block, said straight contact surface of each of said short circuit metal pieces having a protruded portion engaged into the locating groove on a respective stop wall;

a plurality of contact metal pieces, each of said plurality of contact metal pieces being lodged in a respective one of said depressions and having a height dimension substantially equal to a height dimension of said depressions, said contact metal pieces each being of triangular construction, said contact metal pieces each comprising a support portion positioned adjacent a partition wall, a contact surface projected from the support portion toward said rectangular slot for contact with a respective one of said short circuit metal pieces, and a clamping portion for fastening a respective electrical wire thereto; and a cover on said base to hold said sliding block in said rectangular slot, said cover having a rectangular opening disposed in a middle portion thereof and in corresponding relationship with said rectangular slot, wherein said protruding block extends through said opening in order to enable a user to slide said sliding block such that said short circuit metal pieces slide along said contact surfaces of said contact metal pieces in order to make and break an electrical connection and said protruded portions move from one pair of locking grooves to another.

* * * * *